United States Patent [19]

Burgin

[11] 4,010,582

[45] Mar. 8, 1977

[54] BUILDING STRUCTURE

[76] Inventor: Kermit H. Burgin, Rte. No. 1, Box 334, Whitestown, Ind. 46075

[22] Filed: Sept. 24, 1975

[21] Appl. No.: 616,394

[52] U.S. Cl. ..... 52/282; 52/494; 52/502; 52/738

[51] Int. Cl.[2] ..... E04B 2/60

[58] Field of Search ..... 52/282, 500, 502, 498, 52/494, 490, 280, 738, 721; 403/230, 330

[56] References Cited

UNITED STATES PATENTS

| | | | |
|---|---|---|---|
| 409,893 | 8/1889 | Wray | 403/230 |
| 2,447,694 | 8/1948 | Finch | 52/490 |
| 2,998,112 | 8/1961 | Burgin | 52/502 |
| 3,266,209 | 8/1966 | Zibell | 52/490 |
| 3,499,251 | 3/1970 | Sandmann | 52/494 |
| 3,537,217 | 11/1970 | Lickliter | 52/738 |
| 3,831,338 | 8/1974 | Klingensmith | 52/721 |

FOREIGN PATENTS OR APPLICATIONS

| | | | |
|---|---|---|---|
| 1,423,034 | 11/1965 | France | 403/230 |
| 651,731 | 6/1963 | Italy | 52/235 |

*Primary Examiner*—Price C. Faw, Jr.
*Assistant Examiner*—Henry Raduazo
*Attorney, Agent, or Firm*—Jenkins, Hanley & Coffey

[57] ABSTRACT

A building structure comprising a plurality of frame members and wall panels secured together generally in accordance with the teachings of United States patent 2,832,445, each frame member being an elongated generally rectangular cross section frame member defined by front and back walls and side walls with the front wall being slotted and each enclosing panel member having a flange along a longitudinal edge thereof for insertion into the slot of the adjacent frame member. The improvement comprises a protrusion extending outwardly from and longitudinally along each frame member sidewall to serve as a support against which the wall panel cross braces rest and to which the cross braces are clamped. Each protrusion is formed to have a front surface parallel with and facing the front, slotted wall of the frame member and a rear surface which inclines, from its outer edge, inwardly and toward the front slotted surface. Spring-like clamps are attached to the cross members to engage these rear surfaces.

8 Claims, 4 Drawing Figures

BUILDING STRUCTURE

This invention relates to building structures and particularly to an improved frame member for use in setting up a building structure preferably without the use of bolts, screws, rivets, or welding or other similar construction techniques or elements, although it will be understood that such fastening elements or techniques may be used within the scope of the present invention.

This invention represents an improvement in the design of the frame member and associated wall panel disclosed in my U.S. Pat. No. 2,832,445 issued Apr. 29, 1958 and entitled Demountable Metal Building Structure. It is an object of the present invention to provide a frame member for a metal building structure of the type disclosed in my aforementioned United States patent, which frame member, when used as a wall post or roof truss element, has greatly improved load-handling capacity when compared to the load-handling capacity of this frame member disclosed in my prior patent. Specifically, the herein disclosed frame member exhibits improved capacity to resist wind and snow loads, allows maintenance personnel to walk upon the roofs of buildings constructed in accordance with the disclosed invention, and transfers much of the loading of these common occurrences from the more easily deformable panel members of the mountable metal building structures to the more rigid and less readily deformable frame members of such metal building structures. More specifically, the frame member of the present invention is extruded or otherwise formed to have longitudinally extending support means against which the wall panel cross braces rest and to which the cross braces are clamped. The support means are preferably formed to have an inclined clamping surface which facilitates the clamping feature.

These and other objects and advantages of this invention will become apparent to those skilled in the art from the following description of a preferred embodiment and the accompanying drawings of that preferred embodiment, in which.

Figure 1:
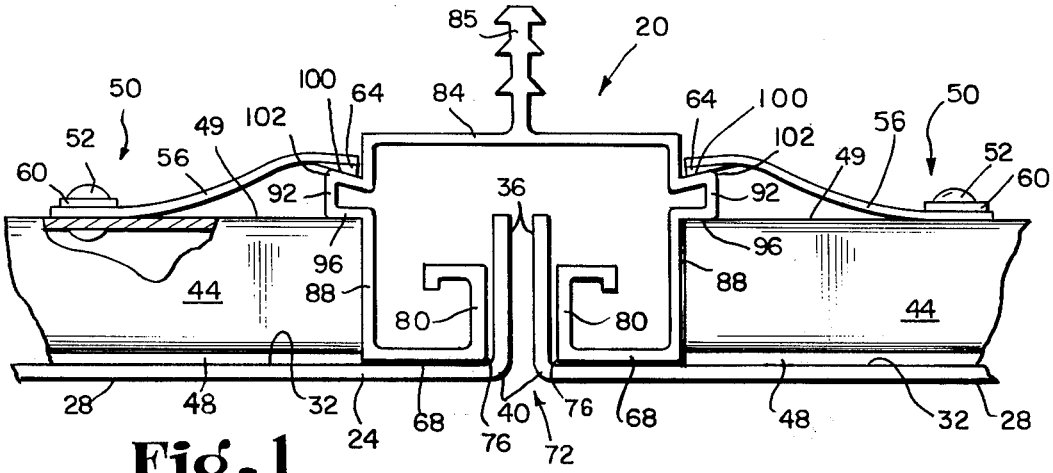
FIG. 1 is a fragmentary, partly sectioned top elevation of a building structure according to the invention.
Figure 2:
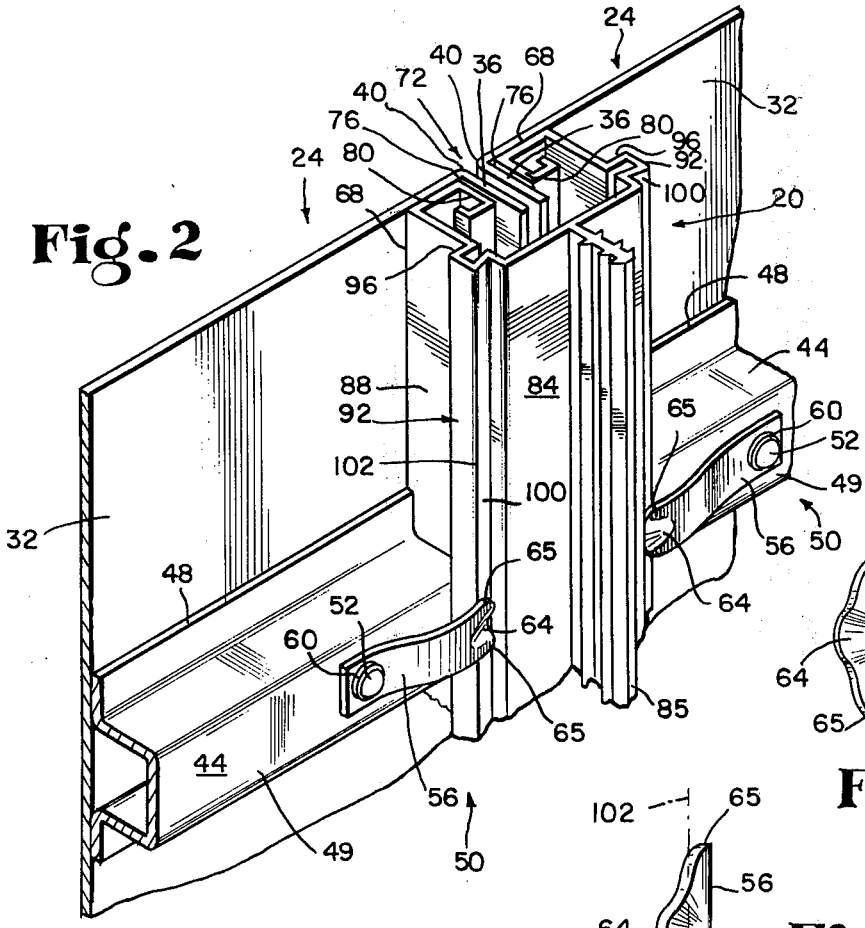
FIG. 2 is a perspective view of the construction detail of FIG. 1.
Figure 3:
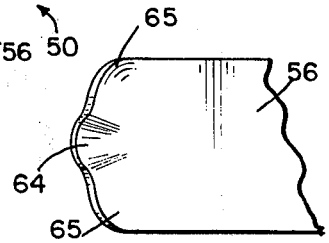
FIG. 3 is a fragmentary top view of a spring clip useable in the building structure.

In the drawings, a building constructed in accordance with the teachings of the aforementioned U.S. Pat. No. 2,832,445 comprises a plurality of frame members 20 which are used as, for example, wall supports and roof trusses, and a plurality of enclosing panel members 24 which may be used as, for example, wall- or roof-covering members. Each of panels 24 includes an exterior wall surface 28 and an interior wall surface 32. A longitudinal flange 36 projects at right angles from an edge 40 of each of panels 24.

One or more hat section cross members 44 are attached to the interior wall 32 of each of panels 24, for instance, by welding or riveting along edges 48 of hat sections 44.

Attached to the top surface 49 of each of hat sections 44 is a latch assembly 50 comprising a rivet 52, a spring clamp bracket 56 and a washer 60. Washers 60 insure the pivotal attachment of spring clamp brackets 56 to surfaces 49 of hat sections 44, and allow spring clamp brackets 56 to pivot about the axes of rivets 52. The free ends or distal ends of spring clamps 56 stand upwardly from surface 49 and a central depression 64 is provided in the free end of each spring clamp 56 while its side corners are rounded and turned up or curled up as indicated at 65. The sides 65 provide surfaces for camming the free end of the clip 56 upwardly over the portion of the frame member 20 to be engaged. The underside of each depressed portion 64 provides a clamping contact surface for attaching each of the panel members 24 to frame members 20 in a manner which will be hereinafter explained.

In a preferred embodiment, frame members 20 are desirably formed from aluminum alloy extrusions. Each frame member 20 has a generally rectangular cross section. The front wall 68 of each frame member 20 has a longitudinally extending slot 72 which opens into the interior thereof. Along the longitudinal edges 76 of each slot 72 are a pair of legs 80 which extend inwardly of frame member 20 generally perpendicularly to wall 68, said legs 80 terminating interiorly of frame member 20 between front wall 68 and a rear wall 84 of frame member 20. A rib 85 which projects outwarly perpendicularly from rear wall 84 and extends longitudinally of frame member 20 is useful for attaching the interior walls of the building structure to frame members 20 as suggested in my U.S. Pat. No. 2,998,112 issued Aug. 29, 1961.

Each frame member 20 is further provided with a pair of opposed side walls 88. Projecting outwardly from each side wall 88 of frame member 20 and extending longitudinally thereof is a flange 92. Each flange 92 has a front surface 96 and a rear surface 100. While surface 96 is generally parallel to the front wall 68, rear surface 100 is inclined inwardly and slightly toward front wall 68 as illustrated.

Figure 4:
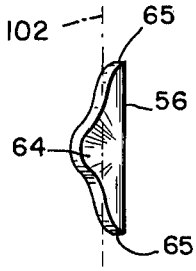
FIG. 4 is an end view of the spring clip.

To assemble panels 24 to frame member 20, flanges 36 along the edges of panels 24 are inserted into slot 72 of frame member 20 until surface 49 of each of hat sections 44 rests against the front surface 96 of protruding flange 92 and wall surfaces 32 rest against front wall 68. Then each of spring clips 56, which have been pivoted to positions out of the way of flange 92 for insertion of flanges 36 of panels 24 into slot 72, are pivoted until depression 64 on spring clips 56 rests against the rear surface 100 of flange 92 thereby locking panels 24 in place with respect to frame member 20. Front surface 96, which makes substantially a right angle with side wall 88 provides a broad area of contact for surface 49 of each hat section cross member 44 which rests against it. Rear surface 100, which makes an acute angle with side wall 88, provides a ridge 102 over which depression 64 of each spring clip 56 rides to lock more securely the panels 24 to the frame member 20. The upturned sides 65 cam the free ends of the clips 56 over the ridges 102, one of said ridges being illustrated diagrammatically in FIG. 4. Each clip 56 is preferably formed such that it can be pivoted about the axis of its rivet 52 to engage its associated ridge 102 and, because of sides 65, be cammed upwardly over the ridge to the engaging position shown in FIG. 1.

It should be noted that with this building structure, wind forces, the weight of snow of maintenance personnel upon exterior surfaces 28 of panels 24 are borne primarily against the supporting frame face 96 of each flange 92 and not primarily against the wall panel members 24. Such forces on panels 24, of course, are directed inwardly against walls or downwardly against roofs. Looking at FIG. 1, such forces on panels 24 are directed upwardly relative to the frame member 20.

While I have shown and prefer to use something like the spring clip 56, it will be appreciated that I may use a clip which is not spring-like and which, in fact, is fastened to the hat section 44 by means of any fastening element to engage the flange 92. That is, the improvement of the flanges 92 as supports against which the hat sections 44 rest may be used with any type of means for fastening the hat sections to the flanges to secure panels 24 to frame members 20.

It will further be appreciated that by extruding the frame members 20 to provide the inwardly inclined rear surfaces 100, I have greatly facilitated the function of clamping the hat sections 44 to the frame members. The inclined surfaces 100 serve as strong and positive portions of any clamping arrangement I may choose to use.

What is claimed is:

1. In a building structure comprising an elongated frame member having a plurality of longitudinally extending walls, one wall having a longitudinally extending slot therethrough, said frame member further having a pair of opposed parallel walls extending from the side edges of said slotted wall, each of the longitudinal edges of said slot having a planar leg extending therefrom generally perpendicularly into said frame member and parallel to said opposed walls, each said leg terminating interiorly of said member, a pair of elongated enclosing panels each having a longitudinal planar flange extending generally perpendicularly from an edge thereof, said panels being positioned approximately edge to edge along said slot with said flanges entering said slot and lying respectively along each of said legs, each of said panels having at least one cross member thereon, said cross members extending generally perpendicularly to said planar flanges, and means for clamping said cross member to said frame member, the improvement comprising a protrusion on each said opposed wall for bearing said cross members thereagainst, said protrusions extending longitudinally of said frame member, each protrusion having two sides, one of said sides facing said slotted wall for bearing said cross member thereagainst and an opposite rear side, said clamping means including a clip attached to said cross member and engaging said rear side, said rear side being formed to have a longitudinally extending outer edge serving as a ridge and to incline inwardly and toward said slotted wall from said outer edge.

2. The improvement of claim 1 in which said clip is a spring-like clip attached to said cross member to have a distal end portion engaging said rear side.

3. The improvement of claim 2 in which said clip is attached to said cross member for pivotal movement about an axis generally perpendicular to said slotted wall, said distal end portion being formed with upturned sides effective to engage said ridge and cam said distal end portion upwardly over said ridge into engagement with said rear side.

4. The improvement of claim 3 in which said distal end portion is provided with a central depression between said sides and serving as a clamping contact surface engaging said rear side.

5. In a building structure comrising an elongated generally rectangular cross section frame member including two pairs of walls, one of the first pair of walls including a longitudinally extending slot, each edge of said slot being provided with a leg running longitudinally of said member and extending into the interior thereof to a distance less than the distance between said first pair of walls, and two elongated enclosing panel members, each provided with a flange along a longitudinal edge thereof for insertion into said slot, said flanges extending into said frame member a distance less than the distance between said first pair of sides, each of said panel members further comprising at least one cross member and each said cross member having clamp means connected thereto for securing said panels to said frame member, the improvement comprising support means for providing a first surface facing said one of the first pair of walls for supporting said cross member and a second surface generally facing the other of said first pair of walls for engaging said clamp means for holding said cross member firmly against said first surface, said support means extending longitudinally along and outwardly from each one of said second pair of walls, said second surface being formed to have a longitudinally extending outer edge serving as a ridge and to incline inwardly and toward said one of the first pair of walls from said outer edge.

6. The improvement of claim 5 in which said clamp means is a spring-like clip attached to said cross member to have a distal end portion engaging said second surface.

7. The improvement of claim 6 in which said clip is attached to said cross member for pivotal movement about an axis generally perpendicular to said one of the first pair of walls, said distal end portion being formed with upturned sides effective to engage said ridge and cam said distal end portion upwardly over said ridge into engagement with said second surface.

8. The improvement of claim 7 in which said distal end portion is provided with a central depression between said sides and serving as a clamping contact surface engaging said second surface.

* * * * *